US005845418A

United States Patent [19]

Chi

[11] Patent Number: 5,845,418

[45] Date of Patent: Dec. 8, 1998

[54] VENTILATION INSOLE WITH AIR CHAMBERS

[76] Inventor: Kuan-Min Chi, No. 23, Alley 51, Lane 2, Sec. 1, Chung-Hsing Rd., Ta-Li City, Taichung Hsien, Taiwan

[21] Appl. No.: 951,383

[22] Filed: Oct. 16, 1997

[51] Int. Cl.[6] ..... A43B 7/08; A43B 13/38

[52] U.S. Cl. ..... 36/3 B; 36/43

[58] Field of Search ..... 36/3 B, 29, 43, 36/44

[56] References Cited

U.S. PATENT DOCUMENTS

| | | |
|---|---|---|
| 1,125,134 | 1/1915 | Lee . |
| 2,030,545 | 2/1936 | Schulze . |
| 2,432,533 | 12/1947 | Margolin . |

FOREIGN PATENT DOCUMENTS

| | | |
|---|---|---|
| 542588 | 5/1956 | Italy . |
| 559926 | 3/1957 | Italy . |
| 692588 | 8/1965 | Italy . |
| 2811 | of 1866 | United Kingdom . |

*Primary Examiner*—Ted Kavanaugh
*Attorney, Agent, or Firm*—Bacon & Thomas

[57] ABSTRACT

A ventilation insole which includes a bottom air chamber layer and a smooth top cover layer covered over the bottom air chamber layer, the bottom air chamber layer having a plurality of intersected ribs, a plurality of recessed air chambers respectively separated from one another by the intersected ribs and closed by said top cover layer and a plurality of air vents at intersected points of the intersected ribs, the smooth top cover layer having a plurality of air vents respectively disposed in communication with the air vents of the bottom air chamber layer.

6 Claims, 4 Drawing Sheets

VENTILATION INSOLE WITH AIR CHAMBERS

BACKGROUND OF THE INVENTION

The present invention relates to insoles for shoes, and more particularly to a ventilation insole which has air chambers for supporting the foot comfortably, and air vents for ventilation.

A variety of shoes have been developed for use in different conditions for different purposes. Regular shoes are commonly equipped with an insole to comfort the feet. A variety of materials including fibers, foamed rubber or plastics (PU, EVA, etc.), etc. have been developed for making insoles for shoes. Regular fabric insoles are less springy, and deform quickly with use. An insole made from foamed rubber or plastics is springy and comfortable in use, however it cannot dissipate heat quickly.

SUMMARY OF THE INVENTION

The present invention provides a ventilation insole which is flexible and springy, fits the sole of the foot comfortably, achieves a satisfactory ventilation effect, and does not deform quickly with use. According to one aspect of the present invention, the ventilation insole is comprised of a bottom air chamber layer and a smooth top cover layer fastened to the bottom air chamber layer by a heat press. When the top cover layer and the bottom air chamber layer are sealed together, air chambers of the bottom air chamber layer are automatically filled with air and closed by the top cover layer to support downward pressure transmitted from the foot through the top cover layer. Air vents are pierced through intersected points of the intersected ribs for ventilation. A guard edge is formed along two opposite lateral sides and border of the rear part of the ventilation insole. When in use, the guard edge surrounds the rear part of the foot. Further, the air chambers have a respective anti-skid bottom wall which prevents the ventilation insole from sliding in the shoe.

DETAILED DESCRIPTION OF THE PREFERRED EMBODIMENT

Figure 1:
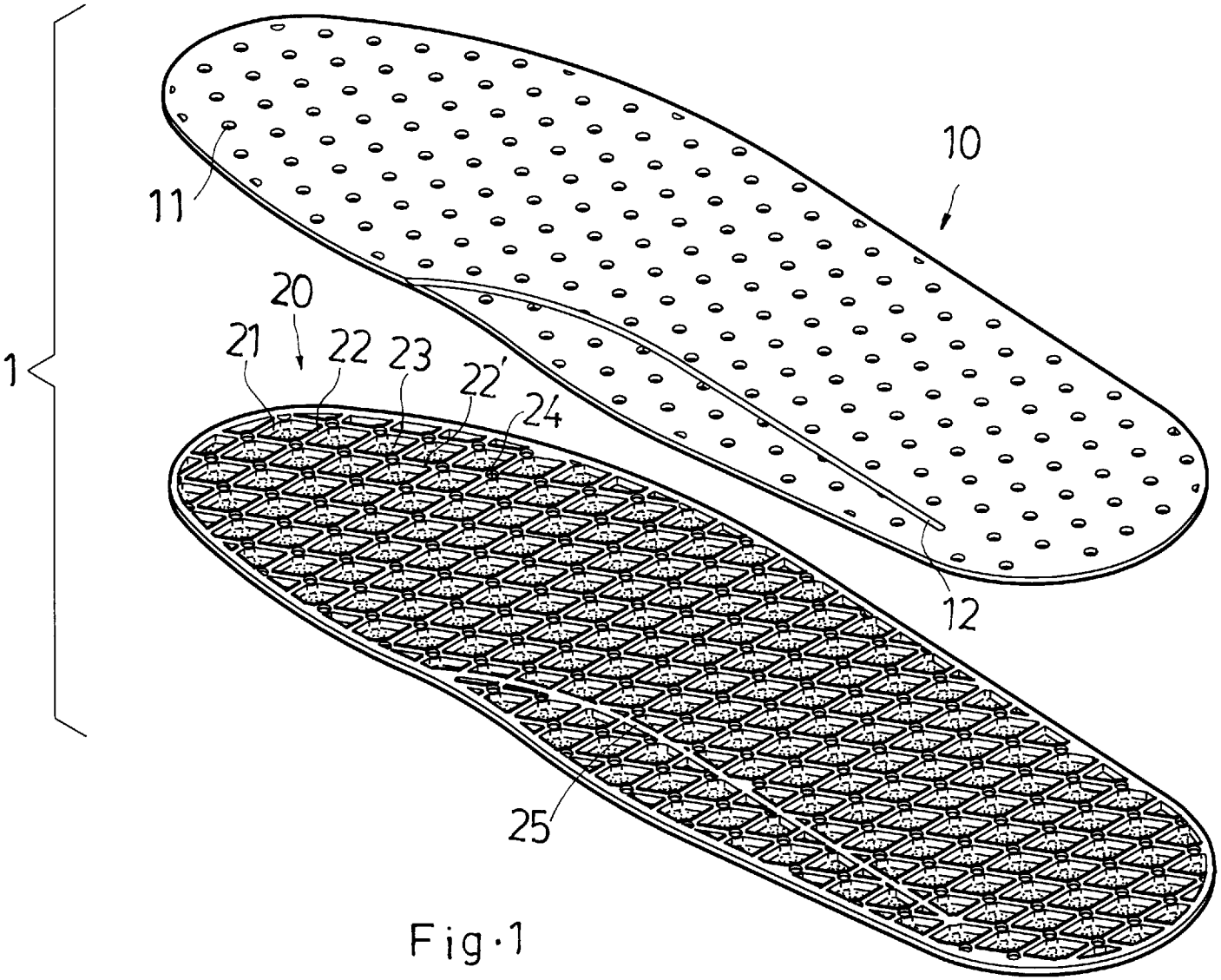
FIG. 1 is an exploded view of a ventilation insole according to the present invention.
Figure 2:
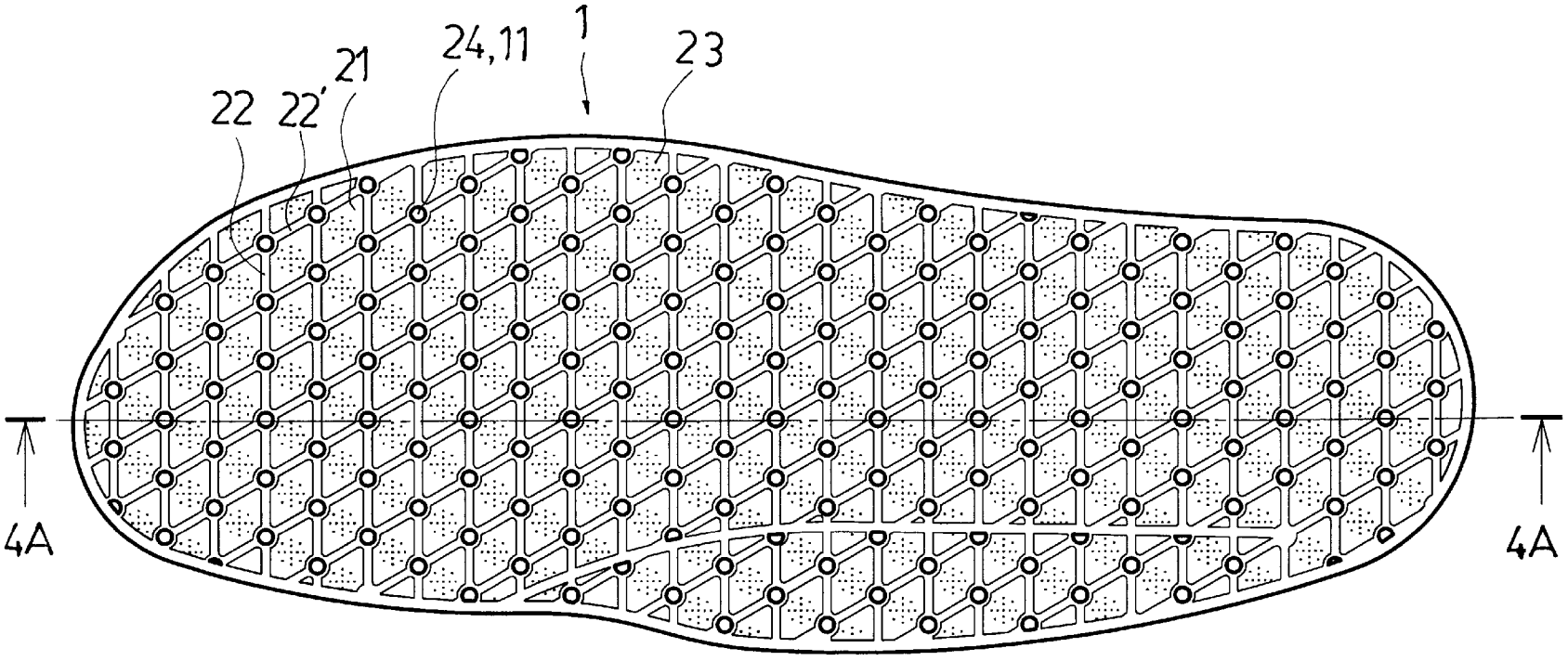
FIG. 2 is a plain view of the present invention, showing the top cover layer and the bottom air chamber layer bonded together.
Figure 3:
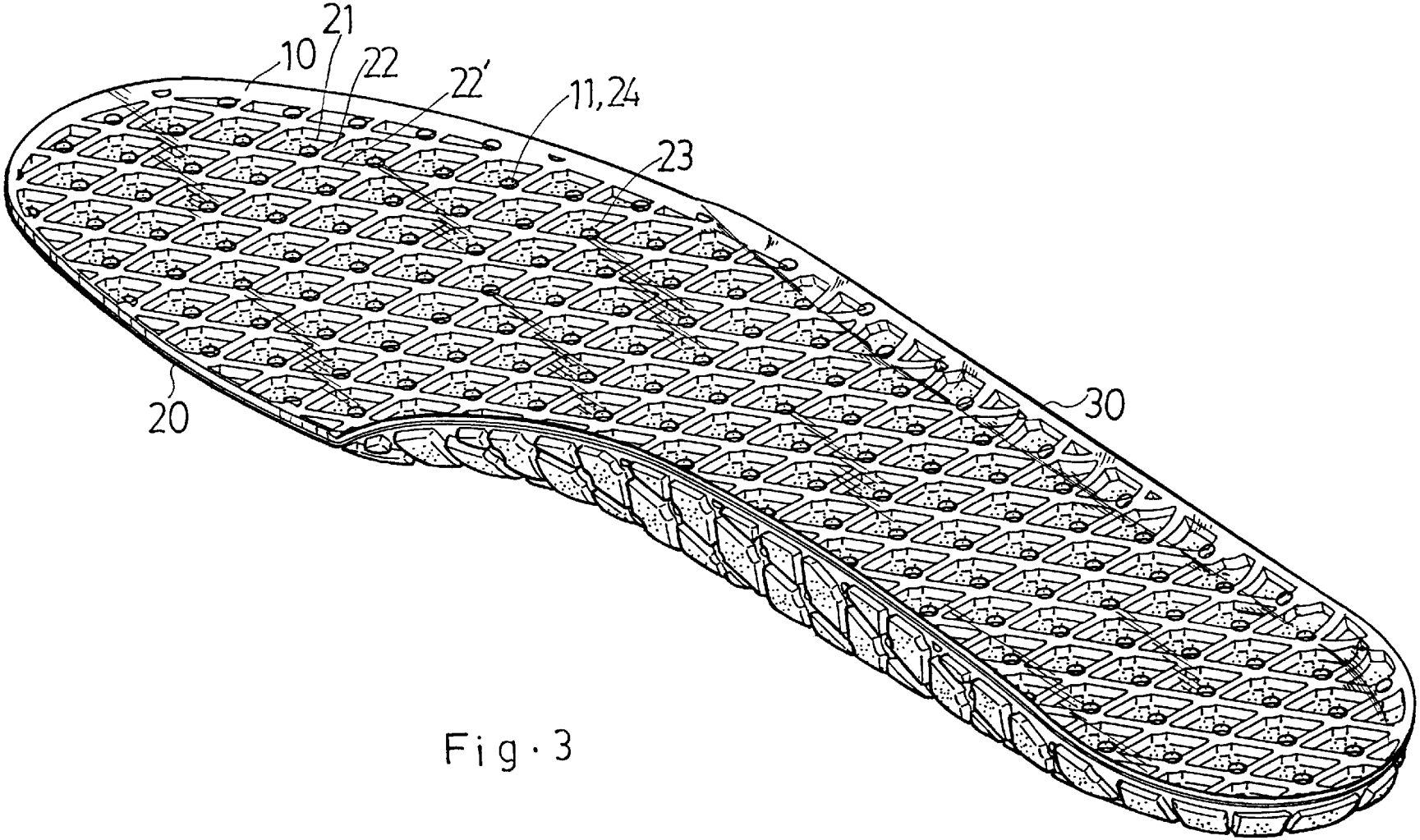
FIG. 3 is a perspective view of the ventilation insole according to the present invention.
Figure 4A:
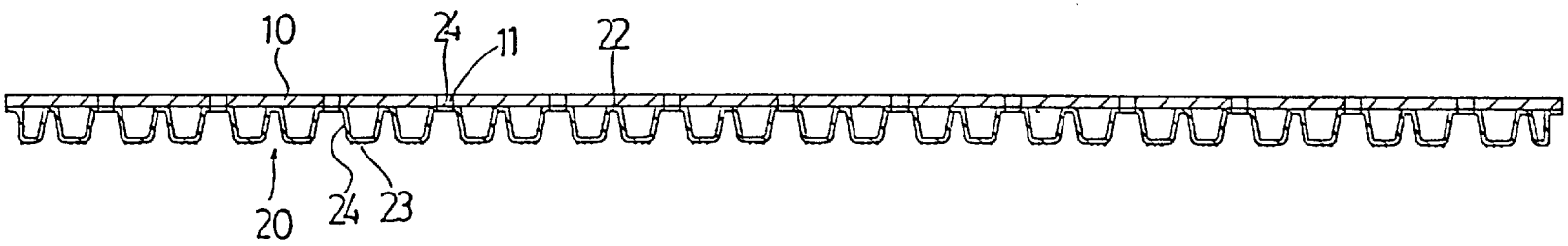
FIG. 4A is a sectional view taken along line 4A—4A of FIG. 2.

Referring to FIGS. from 1 to 4, a ventilation insole 1 is shown comprised of a smooth cover layer 10, and an air chamber layer 20. The air chamber layer 20 comprises a plurality of transverse ribs 22, a plurality of slant ribs 22' respectively intersecting the transverse ribs 22, a plurality of recessed, quadrilateral air chambers 21 separated from one another by the transverse ribs 22 and the slant ribs 22', and a plurality of air vents 24 respectively disposed at intersected points between the transverse ribs 22 and the slant ribs 22'. The transverse ribs 22 are arranged perpendicular to the longitudinal axis of the air chamber layer 20. The air chambers 21 have a respective anti-skid bottom wall 23 which comprises a plurality of small raised portions on the outside. The smooth cover layer 10 has a plurality of air vents 11 corresponding to the air vents 24 in the air chamber layer 20. Further, sealing lines 12;25 are respectively made on the smooth cover layer 10 and the air chamber layer 20 along one side of the plantar arch.

The smooth cover layer 10 is covered on the air chamber layer 20, and then the smooth cover layer 10 and the air chamber layer 20 are fastened together by a heat press. When sealed, the recessed air chambers 21 are filled with air and closed, the sealing lines 12;25 are sealed together, and the air vents 11 of the smooth cover layer 10 are respectively aligned with the air vents 24 of the air chamber layer 20. The border area along the heal and two opposite lateral sides of ventilation insole 1 is bent inwards to form a peripheral guard edge 30. The sealing lines 12;25 serve as a reference line when processing the ventilation insole 1 with a peripheral guard edge 30.

When in use, the ventilation insole 1 is put in the shoe with the air chamber layer 20 attached to the sole of the shoe. When the user' foot is inserted into the shoe and pressed on the ventilation insole 1, the under surface of the foot is disposed in close contact with the smooth cover layer 10 of the ventilation insole 1 and surrounded by the peripheral guard edge 30, and the anti-skid outer walls 23 of the air chambers 21 are forced into close contact with the sole of the shoe to prevent the ventilation insole 1 from sliding in the shoe.

As indicated above, the air chambers 21 of the bottom air chamber layer 20 are separated from one another by the intersected ribs 22;22' and the transverse ribs 22 are arranged perpendicular to the longitudinal central axis of the ventilation insole 1, the ventilation insole 1 can be flexibly bent with the foot when walking without damaging the air chambers 21; because the air chambers 21 have a quadrilateral shape peripherally reinforced by the intersected ribs 22;22' and are not filled up with compressed air (they are filled with air automatically when the bottom air chamber layer 20 and the top cover layer 10 are sealed together), they do not explore when compressed; because air vents 11;25 are made through top and bottom sides of the ventilation insole 1, a satisfactory ventilation effect can be achieved to prevent an accumulation of hot air; because the ventilation insole 1 is provided with a guard edge 30 adapted to surround the rear part of the foot, it fits over the sole of the foot and does not deform quickly with use; because the air chambers 21 are separated from one another by the intersected ribs 22;22', a damage of a particular air chamber does not affect the buffering effect of the bottom air chamber layer 20, and the user can cut the ventilation insole 1 subject to the size of the shoe to be matched without damaging the buffer function of the bottom air chamber layer 20.

What I claim is:

1. A ventilation insole comprising:

a bottom air chamber layer, said bottom air chamber layer comprising a plurality of intersected ribs, a plurality of recessed air chambers respectively separated from one another by said intersected ribs, and a plurality of air vents at intersected points of said intersected ribs; and a smooth top cover layer covered on said bottom air chamber layer to close said recessed air chambers, said top cover layer having a plurality of air vents respectively disposed in communication with the air vents of said bottom air chamber layer.

2. The ventilation insole of claim 1, wherein said recessed air chambers have a quadrilateral shape.

3. The ventilation insole of claim 1, wherein said intersected ribs include a plurality of transverse ribs disposed perpendicular to the longitudinal central axis of said bottom air chamber layer, and a plurality of slant ribs respectively intersecting said transverse ribs.

4. The ventilation insole of claim 1, wherein said recessed air chambers have a respective anti-skid bottom wall, said anti-skid bottom wall having a plurality of raised portions on the outside.

5. The ventilation insole of claim 1, wherein said top cover layer and said bottom air chamber layer have a respective sealing line disposed along one side of the plantar arch and sealed to each other.

6. The ventilation insole of claim 5, wherein said top cover layer and said bottom air chamber layer have a respective part formed with each other into a peripheral guard edge along the sealing lines of said top cover layer and said bottom air chamber layer, and adapted to surround the heal of the foot.

* * * * *